United States Patent [19]

Vincent

[11] Patent Number: 4,947,492

[45] Date of Patent: Aug. 14, 1990

[54] SWIVEL NOZZLE FLUSH TOILET SYSTEM

[75] Inventor: Ray T. Vincent, Los Angeles, Calif.

[73] Assignee: Weber Aircraft, Burbank, Calif.

[21] Appl. No.: 182,163

[22] Filed: Apr. 15, 1988

[51] Int. Cl.[5] ..... E03D 11/08

[52] U.S. Cl. ..... 4/420; 4/321; 4/435; 4/438

[58] Field of Search ..... 4/420, 435, 362, 438, 4/420.4, 321, 440, 439, 441, 442, 322, 323, 425, 492, 420.5, 448, 233, 662, 490

[56] References Cited

U.S. PATENT DOCUMENTS

| | | | |
|---|---|---|---|
| 3,150,399 | 9/1964 | Dick et al. | 4/662 |
| 3,798,681 | 3/1974 | Johansen | 4/440 |
| 3,925,826 | 12/1975 | Huyot et al. | 4/420.4 |
| 3,965,006 | 6/1976 | Otte, Jr. | 4/420 |
| 3,965,492 | 6/1976 | Hendricks | 4/422 |
| 3,979,781 | 9/1976 | Jolicoeur | 4/420 |
| 3,988,788 | 11/1976 | Ave | 4/233 |
| 4,075,718 | 2/1978 | Hargraves | 4/362 |
| 4,156,297 | 5/1979 | Pilolla | 4/321 |
| 4,216,553 | 8/1980 | Haberk | 4/233 |
| 4,242,765 | 1/1981 | Russell | 4/321 |
| 4,404,696 | 9/1983 | Heinze et al. | 4/420 |
| 4,521,925 | 6/1985 | Chen et al. | 4/362 |
| 4,550,454 | 11/1985 | Yui | 4/448 |

FOREIGN PATENT DOCUMENTS

| | | | |
|---|---|---|---|
| 0142847 | 11/1979 | Japan | 4/438 |

*Primary Examiner*—Henry J. Recla
*Assistant Examiner*—Edward C. Donovan
*Attorney, Agent, or Firm*—Lyon & Lyon

[57] ABSTRACT

A lavatory system suitable for use on a commercial passenger aircraft includes a toilet bowl for receiving waste and a waste-holding tank in fluid communication with the toilet bowl for receiving waste from the toilet bowl. A flapper valve is provided in the bottom of the toilet bowl and operates to control the passage of the toilet bowl contents into the waste-holding tank. Water, which may be from the potable water supply system, is directed into the toilet bowl to wash the sides of the toilet bowl and to assist in moving waste material to the waste-holding tank. A water inlet valve controls the introduction of water into the toilet bowl by actuation of a flushing switch. The water is introduced into the toilet bowl through a single nozzle which moves and progressively directs the flow of the water onto the entire interior of the toilet bowl in such a manner that a minimal amount of water is utilized per flush.

14 Claims, 3 Drawing Sheets

SWIVEL NOZZLE FLUSH TOILET SYSTEM

BACKGROUND OF THE INVENTION

This invention relates to toilet systems that utilize fluid pressure from a water supply to flush waste material from the toilet bowl to a waste-holding tank and in particular relates to such toilet systems in which the flushing liquid is not recirculated and which utilize fresh water for each flush to rinse the toilet bowl and assist in the evacuation of the waste matter from the bowl.

This system using fluid pressure for flushing is especially desirable in applications where the use of water and gravity to flush waste from the bowl are restricted by the limited availability of large quantities of water for use in the flushing operation. Examples of situations in which water supplies are limited include commercial passenger aircraft and other commercial conveyances, such as trains and boats, and also in vacation and resort dwellings that are located in remote areas with no municipal water system.

Previously, most toilet systems used in commercial aircraft have been of the recirculating type wherein the flushing liquid and waste material removed from the toilet bowl pass through a filtering system and the flushing liquid is recycled for use in later flushing of the toilet bowl. While typical recirculating flushing systems serve the purpose, they require a large-capacity filtration system in order to separate the flushing liquid from solid waste, thereby permitting the reuse of the flushing liquid. These toilets also require a pump and an electric motor for flushing. Such filtration systems and motor-pump assemblies require frequent maintenance and servicing.

On the other hand, the use of a freshwater flushing eliminates both the filtration and motor-pump problems. The most logical source of flushing liquid for the commercial aircraft is the potable water supply, since each aircraft is generally equipped with one. However, use of the potable water supply for toilet flushing imposes a strict requirement that each flush use a minimum amount of water in order to conserve storage volume and minimize water weight in the aircraft. Also, to avoid complications in pressure regulation and valving, it is desirable that the pressure required of the flushing liquid be no higher than the potable water pressure so that the same valving and pressure-regulating equipment can be used for both the potable water and the flushing water.

SUMMARY OF THE INVENTION

The preferred embodiment of the present invention is a toilet system in which the toilet bowl may be satisfactorily flushed with a minimum amount of water. Upon actuation of a flush switch, a flapper valve near the bottom of the bowl automatically opens to the waste-holding tank for a predetermined time to allow evacuation of the waste from the toilet bowl. Water, such as available from the aircraft potable water system, is introduced into the toilet bowl upon actuation of the flush switch to flush the toilet bowl and move the waste to the bowl exit. The water and waste is thereby evacuated from the bowl and discharged to the waste-holding tank.

The toilet bowl utilized in the toilet system of the preferred embodiment has an upper portion and a lower portion, the lower portion of the bowl being in fluid communication with the drain means. The upper portion of the toilet bowl includes a conventional waste-receiving opening and a rim of substantially oval configuration affixed to the upper portion of the bowl surrounding the waste-receiving opening. Typically, a seat suitably adapted to the shape of the rim is mounted upon the rim in a conventional manner. A water nozzle is affixed to the bowl and the water nozzle is fluidly coupled to a water supply to provide rinsing liquid to the toilet bowl. The nozzle swivels and directs streams of water onto the sides of the toilet bowl to wash waste material and effluent from the sides of the bowl and to direct the waste material toward a toilet bowl exit. The water and waste drop from the bowl exit into the tank through a flapper valve which may be automatically opened by fluid pressure unleashed by the water inlet valve.

The objects and advantages of the present invention may include the following:

utilizing the least amount of water in the flushing operation, while still providing sufficient water to clean the entire interior surface of the bowl and move all the solid waste matter to the toilet bowl exit opening;

orientating the nozzle to eliminate the swirling action of the water, which is normally found in conventional household flush toilets;

eliminating the swirling action shortens the path that the water must travel from the nozzle to the toilet bowl exit, thereby permitting a smaller amount of water to completely wash the bowl while at the same time maintaining sufficient energy in the water to move solid waste to the bowl exit;

attaining higher fluid pressure at the nozzle through the use of a single nozzle rather than the multi-nozzles found on vacuum systems with their attendant large pressure drops due to much higher flow rates;

the bowl design may be of normal curvature found in ordinary home toilets as contrasted to the vacuum system which requires a special design;

low cost and low weight design requires no pump, motor, blower, pinch valve, complicated controllers, or filtration system; and low power requirement—only the electric water inlet valve requires power.

DETAILED DESCRIPTION OF THE PREFERRED EMBODIMENT

The preferred embodiment will now be described with reference to the figures. For the convenience of description, any numeral identifying an element in one figure will represent the same element in any other figure.

Figure 1:
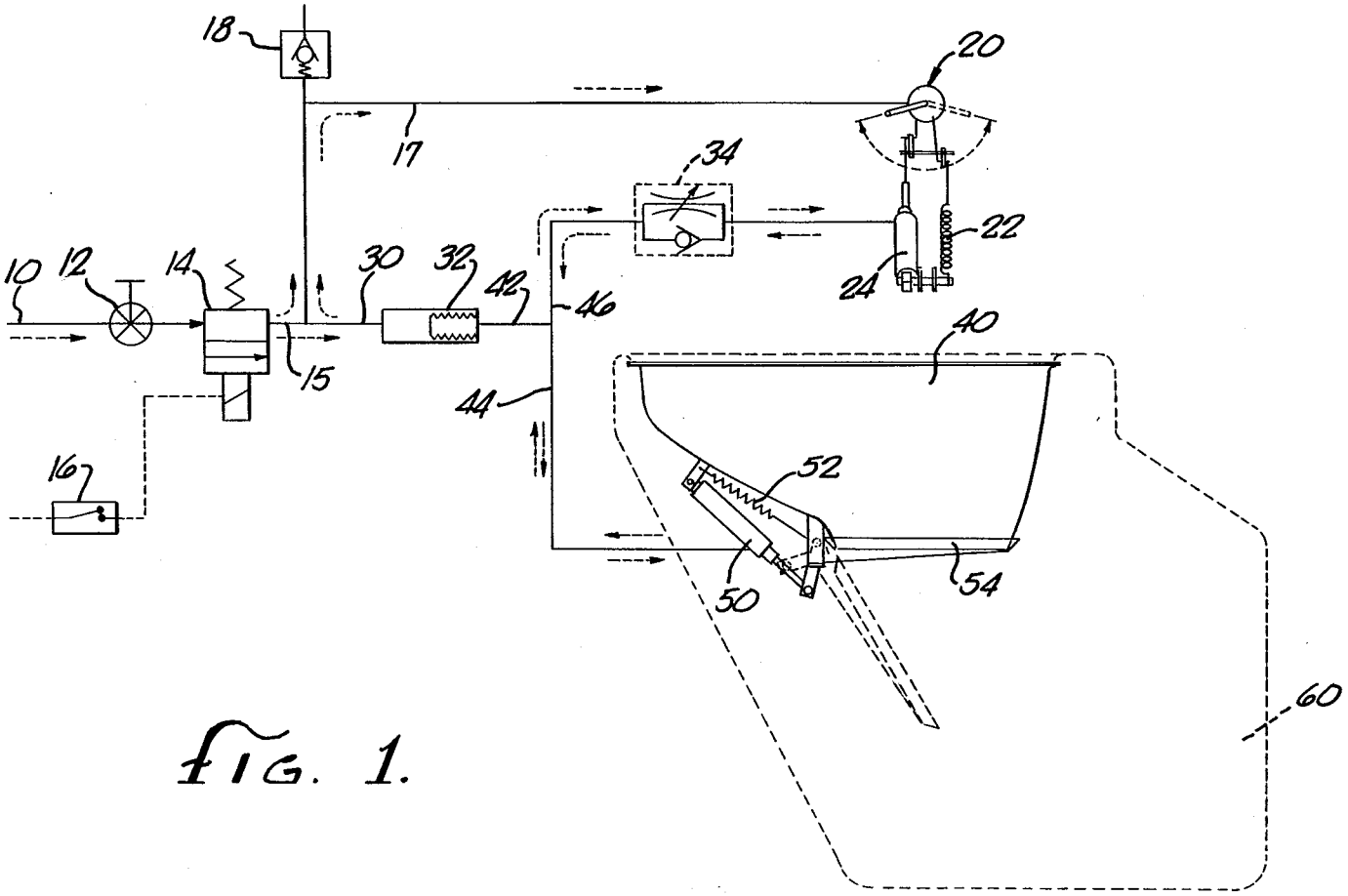
FIG. 1 is a schematic representation of a flush toilet system of this invention utilizing a freshwater flush.

FIG. 1 is a schematic representation of a non-recirculating non-vacuum flush fresh water system system designed in accordance with the principles of the present invention for use in a commercial passenger aircraft, such as the Boeing 767. In the illustrated embodiment the water inlet valve 14 is connected to the freshwater feed line 10, which leads from the potable water system of the aircraft to the toilet bowl 40. Operation of the flush switch 16 opens the water inlet valve 14 to permit water to flow through the lines 15 and 17 to the toilet bowl 40. Preferably, the water inlet valve 14 is sequenced so that a predetermined time after it is opened by the actuation of the flush switch 16 the water inlet valve 14 closes and fresh water no longer flows into the toilet flush system from the potable water system.

The water inlet valve 14 may be actuated by a solenoid upon signal from the flush switch 16. The flush switch 16, which may be manually operable, may have a timer means associated therewith to control the flushing operation by opening inlet valve 14 for a predetermined time period, thereby permitting a predetermined quantity of water to flow into the toilet flush system. The timer means may also include a delay means for preventing the flushing operation for a predetermined time period after a previous flush. Together, the flush switch 16 and the inlet valve 14 comprise a means for regulating the amount of water entering the bowl 40 per flush. Upon actuation of the water inlet valve 14, fresh water flows into the freshwater feed line and through line 17 to a nozzle 20 through which the water is directed onto the interior walls of the toilet bowl 40 to wash the waste matter from the toilet bowl 40 and move it toward the bowl exit at the flapper valve 54.

Preferably, the freshwater line 10 has a manual shutoff valve 12 associated with it, which may be manually activated so that, in the event of power failure or valve failure in the open position, the fresh water may be manually shut off to prevent overflowing of the toilet bowl 40 or excessive use of the potable water, which is in limited supply on the typical commercial aircraft. The shutoff valve 12 may also provide isolation of the flush system for maintenance needs.

To comply with health rules, a conventional vacuum breaker 18 is installed in line 17 at the interface with the toilet bowl 40 to prevent siphoning of water from the bowl back through the freshwater line 10 to the potable water supply.

Figure 2:
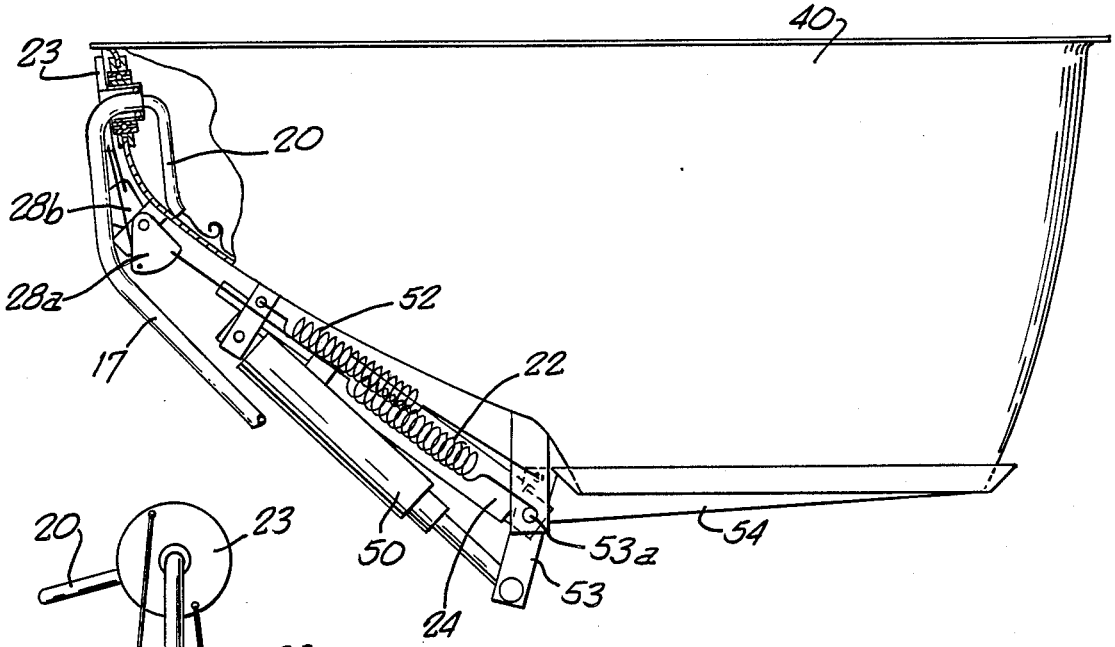
FIG. 2 is a diagrammatic side view of the toilet bowl and associated hardware for use in a flush toilet of FIG. 1.

Referring to FIGS. 1 and 2, a waste-holding tank 60 is shown with a toilet bowl 40 draining into it. Flapper valve 54 is installed at the bowl exit to allow flushing of the waste from the toilet bowl 40. The flapper 54 also helps restrict the odor of chemicals and wastes to the confines of the waste-holding tank 60 when the flapper 54 is closed. Therefore, the flapper valve 54 is normally in a closed position until such time the toilet bowl 40 is used for the depositing of waste and it is desired to empty the contents of the toilet bowl 40 into the waste-holding tank 60 at which time the flapper valve 54 is opened.

When line 15 is pressurized, water also passes through line 30 and into the water/oil separator 32 and starts displacing the hydraulic fluid in the separator 32. This displaced hydraulic fluid which is now under pressure starts moving through lines 42 and 46 to flow control valve 34. The pressurized fluid flowing through flow control valve 34 is directed to an actuator 24 in the form of a piston and cylinder which develops a force large enough not only to overcome the spring tension of spring 22 but also to rotate swivel nozzle 20 from its original position. The speed of rotation of swivel nozzle 20 is regulated by flow control valve 34 and therefore adjusted to effect one complete sweep of the swivel nozzle 20 while spraying water from one side of the bowl 40 to the other within the period of time the water inlet valve 14 is open.

Concurrently, displaced pressurized fluid from the separator 32 also begins flowing through line 44 into actuator 50 which develops a force necessary to overcome the spring tension of spring 52 and to actuate flapper valve 54 to its fully open position. A reason for designing this flapper valve 54 to open by fluid pressure rather than opening due to the weight of flush water on top of itself is that the weight of eight ounces of flush water may be insufficient to open a flapper valve installed in recirculating toilet flush systems where the volume of flush water for each flushing operation is normally in the three-gallon range. The present invention may therefore be retrofitted over an existing installation without replacing the existing bowl.

The second phase of the cycle begins when the predetermined time the water inlet valve 14 is opened has elapsed. As the inlet valve 14 closes, line 10 ceases to provide water to the system. Since line 15 is no longer pressurized by line 10 and the nozzle 20 is open to the atmosphere, water in the water/oil separator 32 can now be displaced by fluid returning from actuators 24 and 50. Spring tension of the spring 22 now overcomes the frictional drag on the actuator 24 and forces the fluid from the actuator 24 back through the flow control valve 34 to water/oil separator 32. This action by the spring 22 returns the swivel nozzle 20 back to its original position. In much the same way, spring 52 overcomes actuator 50 which expels its fluid back to the separator 32. Actuator 50 may be constructed in such a way as to regulate the flow of fluid thereby preventing the sudden closing of the flapper valve 54. Gradual closing of the flapper valve 54 precludes the possibility of splashing water back into the toilet bowl 40.

Once the flapper valve 54 has returned to its closed position, it is desirable to seal the gap between the flapper 54 and bowl exit. For that purpose, a highly pliable rubber seal (not shown) is attached around the outer rim of the bowl exit. This seal is in contact with the horizontal surface of the flapper 54 for sealing purposes when the flapper 54 is in the closed position.

Figure 3:
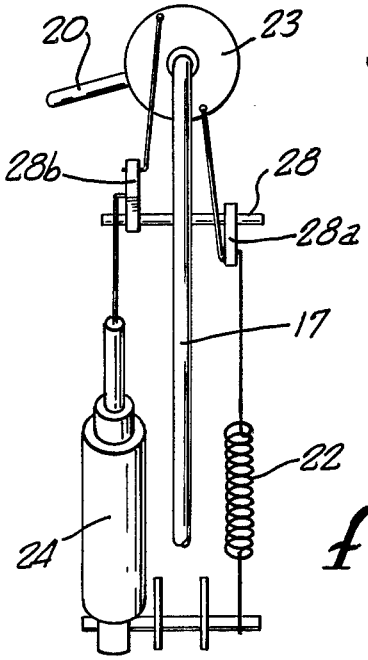
FIG. 3 is a detailed front elevation view of a portion of the spray nozzle and nozzle actuator shown in FIG. 2.
Figure 4:
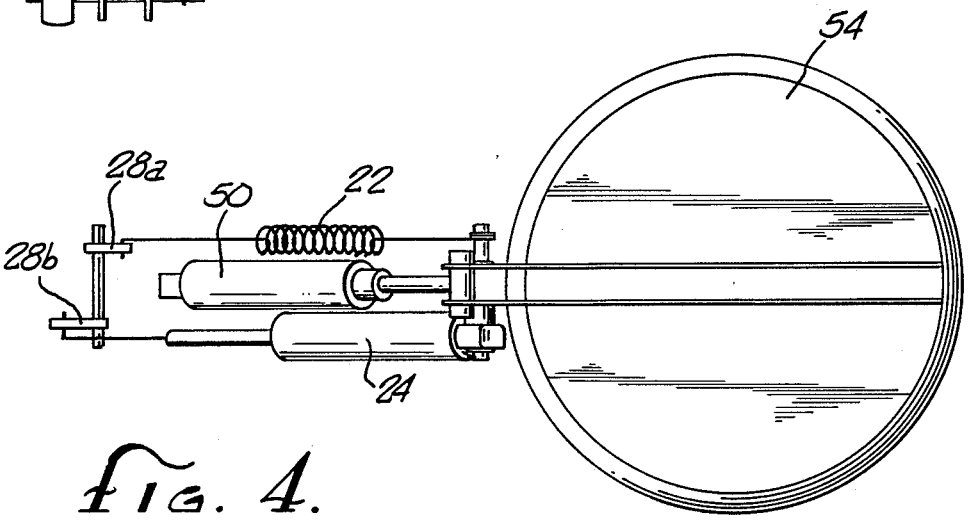
FIG. 4 is a plan view of a portion of the mechanism illustrated in FIG. 2 showing a nozzle actuator, flapper valve, and flapper valve actuator.

Details of the mechanical actions of the flapper 54 and the nozzle 20 are shown in FIGS. 2, 3 and 4. The flapper actuator 50 and the nozzle actuator 24 are neatly positioned under the front of the bowl 40 to conserve space. The flapper actuator 50 is connected to one end of a bell crank arm 53 which is supported by and pivots about a pivot **53*a*. The flapper valve 54 is supported on the bell crank arm 53 at the pivot 53*a* and pivots open and closed as the bell crank arm 53 is rotated. Upon energization, the actuator 50 contracts pivoting the bell crank arm 53 thereby swinging the flapper valve 54 open. The spring 52 is connected to the other end of the bell crank arm 53, the spring 52 biased in tension to pivot the bell crank arm 53 and close the flapper 54 to return the actuator 50 to its original position upon deenergization. The swivel action of nozzle 20 is performed by the energization of the actuator 24, the actuator 24 contracting when energized. The actuator 24 is connected to and rotates a pivot lever 28*b* which is in turn connected to and rotates a swivel plate 23 to which the nozzle 20 is connected for causing the swivel action of the nozzle 20. The pivot lever 28*b* and another pivot lever 28*a* are fixedly mounted on a pivot shaft 28. Upon deenergization of the nozzle actuator 24, spring 22 contracts rotating the pivot lever 28*a* thereby rotating the plate 23 and returning the nozzle 20 to its original position. In this manner the plate 23 and nozzle 20** may be conveniently rotated through an arc of about 135°. The mechanism could be modified to rotate the nozzle through an arc of slightly less than 180°.

Figure 5:
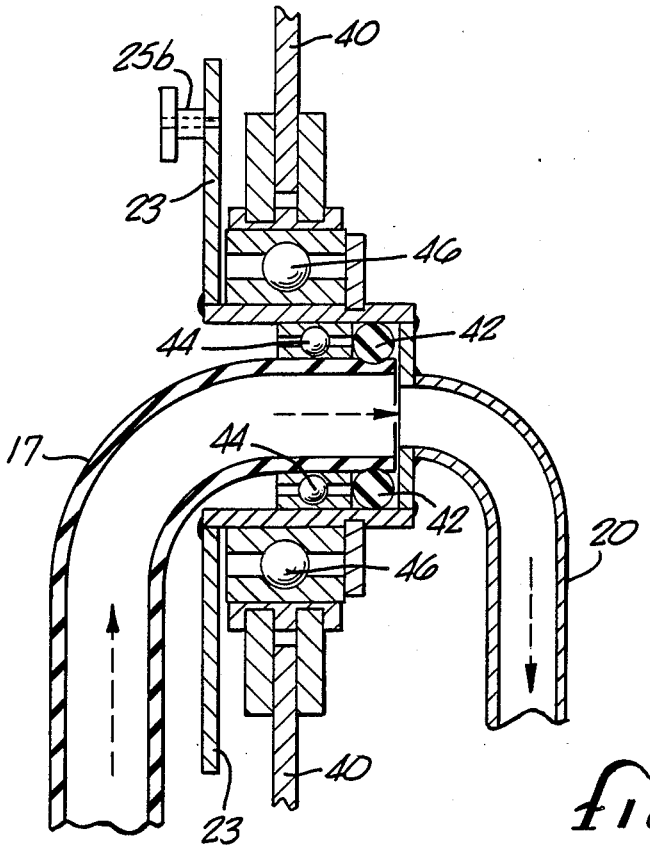
FIG. 5 is a detailed cross sectional view of the spray nozzle shown in, FIG. 2.

FIG. 5 illustrates details of the swivel nozzle 20. Water enters the nozzle 20 through line 17 passing through the wall of the toilet bowl 40. The nozzle 20 is rotated through rotation of the plate 23 attached thereto. The nozzle 20 is allowed to rotate relative to the bowl 40 by a bearing 46 supporting the swivel plate 23 on the bowl 40. The nozzle 20 rotates relative to line 17 which is supported by bearing 44. A sealing means such as an O-ring 42 is positioned between the nozzle 20 and the line 17 to prevent leakage of water.

Figure 6:
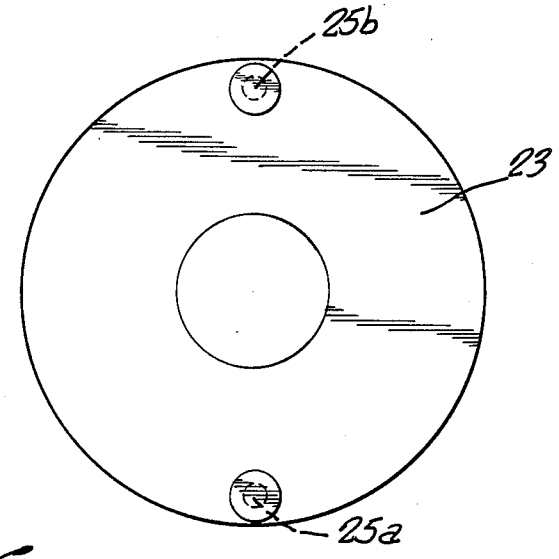
FIG. 6 is a plan view of the nozzle swivel plate shown in FIG. 5.

FIG. 6 is a rear view of the nozzle swivel plate 23. A hole **25*a* located in the bottom of the plate 23 is operably connected to the pivot lever 28*a* and a hole 25*b* located in the top of the plate 23 is operably connected to the pivot lever 28*b***. Such connections may be made by cables, wires, connector arms or the like.

An advantage to utilizing this system in a commercial passenger aircraft is in minimizing the amount of water needed to wash the toilet bowl during each flushing operation so that the aircraft is able to carry a sufficient amount of water to handle the needs of the passengers in a typical maximum flight. Preferably, a flush should consume less than ten ounces of water. To achieve a proper flushing action, approximately six to ten ounces of water is required. If the amount of water utilized in each flushing operation is kept to approximately eight ounces in volume, the aircraft, such as the Boeing 767, can carry sufficient water to operate the toilet systems throughout a typical maximum flight without unduly taxing the potable water supply. In order to properly flush the toilet bowl 40 with only eight ounces of water, it is necessary to introduce the water into the bowl 40 through a nozzle 20 which can forcefully spray and sweep and the sides of the bowl 40, rather than simply allowing the water to flow through apertures found in the typical home toilet. The directed stream of flush water produced by the swiveling nozzle 20 impinges on all sides of the bowl 40. All interior surfaces of the bowl 40 are rinsed thoroughly, but without overlap, so that no water is wasted in washing the same area twice.

Most conventional toilets are designed to promote a swirling effect of a large quantity of the flush water as it travels along the sides of the bowl in order to completely cover the sides of the bowl and remove all waste particles. The swirling of the water increases the length of the path that the water travels prior to contacting the solid debris and exiting the bowl. The longer the path the water travels toward the exit, the more water energy is consumed in transporting the water to the bowl exit rather than in directing all of the energy of the water to washing the sides and bottom of the bowl to remove waste therefrom.

In a vacuum flush system, such as described in U.S. Pat. No. 4,521,925, a bowl with straight sloping sides provides substantially a straight-line path for the water from the rim to the exit with no swirling. The shortened path ensures that substantially all the water energy is utilized in removing waste material from the interior surfaces of the bowl. Still, with that system the energy is dissipated in terms of pressure drop due to the high flow rates of a large number of nozzles.

The present invention, however, utilizes a single nozzle 20 which ensures a minimum resulting pressure drop with a net operating pressure approximately four times that of a conventional vacuum flush system. This higher pressure achieves efficient cleaning and flushing without the assistance of a complex vacuum system. In non-recirculating vacuum toilet flush systems for aircraft, it is desirable to limit the amount of water for each flushing operation to about eight ounces by volume. To flush the toilet with only eight ounces of freshwater, the vacuum systems require the use of up to nine nozzles which direct streams of water along the sides of the bowl, rather than simply allowing the water to flow through apertures as normally encountered in the typical aircraft recirculating toilet systems. However, a weakness inherent in using multi-nozzles in vacuum systems is that the water pressure from the supply system suffers a large drop in pressure at the nozzles between the inlet valve and the tip of the nozzles.

The large pressure drop from the inlet valve to the multi-nozzle is due to the high water flow rate, that is, eight ounces of water in one second. The present invention on the other hand insures minimum pressure drop due to low flow rate; i.e. eight ounces in eight seconds by the use of a single nozzle and thereby realizes four times as much pressure at the nozzle than which could be realized by the multi-nozzle arrangement found in the present non-recirculating vacuum systems. The higher water pressure realized at the single nozzle 20 in the present invention achieves a more efficient rinsing of the interior surface of the bowl 40 while at the same time developing a greater force to move wastes towards the bowl exit.

The spray coverage of the nozzle 20 as it sweeps the sides of the bowl 40 from one side to the other takes the shortest straight-line path while still covering substantially all of the interior surface of the bowl so that the maximum percentage of the water energy is consumed in washing waste from the sides of the bowl 40 and moving the waste to the bowl exit opening. The tip of the nozzle 20 is positioned to direct water streams at an angle so that there is virtually no splash of the water and so that the streams of water coalesce and move smoothly from the point of impingement to the waste drain opening in a substantially uniform sheet of water along the sides of the bowl 40.

In a preferred embodiment of the invention, at least a portion of the interior surface of the toilet bowl 40, i.e., the portion upon which solid debris is primarily deposited at the bottom on the bowl, may be coated with a nonstick material such as polytetrafluoroethylene sold under the trademark "Teflon" by the DuPont Chemical Company or some other like material, such as that sold under the trademark "Silverstone" by the DuPont Chemical Company. While this coating may be similar to coatings applied to a toilet bowl of the vacuum flush system, the physical configuration of the toilet bowl in this invention is ordinary and does not require the special design of that of the vacuum flush system.

The bowl 40 may have a substantially oval upper rim surrounding a waste-receiving opening of the bowl 40. The bowl sides are substantially planar and converging as they extend downward from the rim. Such a design enhances flow of waste material toward the exit of bowl 40.

Thus, a novel flushing technique has been disclosed comprised of a single nozzle which swivels and directs flushing fluid along the surface of the bowl to flush solid waste toward the waste outlet. The toilet system may be particularly suitable for use in commercial aircraft or other applications where a limited supply of flushing fluid or a limited sewerage capacity is available. While particular embodiments of the invention have been described and illustrated herein, it will be apparent to those of ordinary skill in the art that many modifications can be made while remaining within the scope of the present invention. Therefore, the scope of the present invention is not to be limited except in the spirit of the appended claims.

I claim:

1. A flush toilet system utilizing fresh water to assist in flushing comprising:

a toilet bowl for receiving waste, said toilet bowl including an upper portion and a lower portion, said bowl having an exit opening formed in the lower portion thereof;

a waste-holding tank;

drain means providing fluid communication between said toilet bowl and said waste-holding tank for conveying waste from said toilet bowl to said waste-holding tank;

water introduction means connected to said toilet bowl and to a source of fresh water for supplying a flow of fresh water to said toilet bowl;

a water inlet valve means connected to said water introduction means and selectively operable to begin and stop the flow of fresh water to said toilet bowl;

a flapper valve positioned to pivot against the exit opening formed in the lower portion of said bowl, said flapper valve operable to permit the passage of waste through said drain means, said flapper valve being opened automatically by inlet line water pressure when the water inlet valve is opened; and nozzle means mounted on said toilet bowl and in fluid communication with said water introduction means, the nozzle means protruding from a side of said toilet bowl, said nozzle means pivoting during flushing to direct water from said water introduction means onto inside walls of said toilet bowl by means of a sweeping motion.

2. The toilet system of claim 1 further comprising:

a timer means coupled to and associated with said water introduction means to control flushing operation of said water introduction means in a predetermined time period.

3. The toilet system of claim 2 further comprising:

a flushing switch manually operable and coupled to said timer means for actuating said timer means, said timer means including a delay means for preventing the flushing operation of said water introduction means for a predetermined time period after a previous flushing operation of said water introduction means.

4. The toilet system of claim 2 wherein said timer means is adapted to operate said water introduction means to permit a predetermined quantity of water into said toilet bowl.

5. The toilet system of claim 4 wherein said predetermined amount of water is less than about ten ounces.

6. The toilet system of claim 4 wherein said predetermined amount of water is in the range of about six to about ten ounces.

7. A flush toilet system utilizing fresh water to assist in flushing comprising:

a toilet bowl for receiving waste;

a waste-holding tank;

drain means providing fluid communication between said toilet bowl and said waste-holding tank for conveying waste from said toilet bowl to said waste-holding tank;

water introduction means connected to said toilet bowl and to a source of fresh water for supplying a flow of fresh water to said toilet bowl;

a water inlet valve means connected to said water introduction means and selectively operable to begin and stop the flow of fresh water to said toilet bowl; and a flapper valve associated with said drain means and operable to permit the passage of waste through said drain means, said flapper valve opening automatically by water pressure when the water inlet valve is opened, wherein said toilet bowl includes an upper portion and a lower portion, said bowl having an exit opening formed in the lower portion thereof, said exit opening being in fluid communication with said drain means and wherein said water introduction means includes a nozzle mounted on an upper front portion of said bowl in fluid communication with said source of fresh water, said nozzle means being constructed and positioned to swivel to direct stream of water from said nozzle along the interior surfaces of said bowl, said nozzle being oriented such that the impingement of said water on said interior surfaces of said bowl occurs without splash of said water toward the upper portion of said bowl and further positioned so that the nozzle's sweeping motion is designed to produce a water stream that is dedicated to cover substantially the entire area of said interior surface of said toilet bowl and wash waste from said toilet bowl toward said exit opening.

8. A flush toilet comprising:

a bowl having a substantially oval upper rim surrounding a waste-receiving opening of the bowl, the bowl having sides which are substantially planar and converging as they extend downwardly from said rim;

a waste outlet formed in the bottom of said bowl, said outlet opening rearwardly;

a water introduction mean in fluid communication with a water supply; and a nozzle mounted proximate to said rim to one side of said bowl and in fluid communication with said water introduction means, said nozzle swiveling during flushing and providing a stream of water in a sweeping motion along the interior of said bowl to wash waste from said bowl through said waste outlet, said nozzle being positioned so that said stream of water during the sweeping motion of the nozzle is directed downwardly and rearwardly toward said outlet along a shortest straight-line path and further arranged so that said stream impinges said sides of said bowl at an angle such that no splashback of water occurs in a direction toward said waste-receiving opening.

9. The toilet according to claim 8 wherein said nozzle is further arranged such that streams of water coalesce to form a substantially uniform sheet of water along the sides of said toilet bowl.

10. The toilet according to claim 9 further comprising: a means for regulating an amount of water entering said bowl for each flush.

11. The toilet according to claim 10 wherein said amount of water entering said bowl is less than ten ounces for each flush.

12. The toilet according to claim 10 wherein said amount of water entering said bowl is in the range of six to ten ounces for each flush.

13. A flush toilet comprising:

a toilet bowl for receiving waste;

a source of flushing fluid;

an inlet valve connected to said source of flushing fluid and selectively operable to begin and stop a flow of flushing fluid to said toilet bowl;

a flush switch for actuating said inlet valve;

a means for opening said inlet valve for a predetermined time upon actuation of said flush switch such that a predetermined amount of flushing fluid passes through said inlet valve;

a waste outlet formed in the bottom of said bowl;

drain means in fluid communication with said waste outlet for conveying waste out of said toilet bowl;

a flapper valve associated with said drain means and operable to permit the passage of waste into said drain means from said toilet bowl, said flapper valve opening automatically by fluid pressure when said inlet valve is opened; and a nozzle means in fluid communication with said source of flushing fluid through said inlet valve, said nozzle mounted proximate to a rim of the bowl and to one side of said bowl, said nozzle swiveling during flushing for providing streams of fluid in a sweeping motion along the interior of said bowl to wash waste from said bowl through said waste outlet, said nozzle being positioned so that the streams of fluid are directed downwardly toward said outlet.

14. A flush toilet system for a toilet bowl comprising: a single nozzle for mounting in the toilet bowl and to one side thereof in a manner to move relative to the toilet bowl, means for supplying fluid to said nozzle, means for causing said nozzle to move in response to flush actuation, and means for moving said nozzle during flushing relative to said toilet bowl in a controlled pattern for directing a stream of fluid progressively over substantially the entire toilet bowl for flushing water from the toilet bowl.

* * * * *